United States Patent [19]

Thomanek

[11] 3,974,771

[45] Aug. 17, 1976

[54] SPLINTER WARHEAD FOR GUIDED FLYING BODIES FOR COMBATING AERIAL TARGETS

[75] Inventor: Franz Rudolf Thomanek, Schrobenhausen, Germany

[73] Assignee: Bolkow Gesellschaft mit beschrankter Haftung, Ottobrunn, Germany

[22] Filed: Aug. 9, 1967

[21] Appl. No.: 661,165

Related U.S. Application Data

[63] Continuation-in-part of Ser. No. 670,481, June 26, 1967, abandoned.

[52] U.S. Cl. ..... 102/67; 102/24 HC

[51] Int. Cl.[2] ..... F42B 13/48

[58] Field of Search ..... 102/67, 24, 89, 24 HC

[56] References Cited

UNITED STATES PATENTS

| | | | |
|---|---|---|---|
| 1,216,364 | 2/1917 | Roger | 102/66 |
| 2,972,949 | 2/1961 | MacLeod | 102/67 |
| 3,228,336 | 1/1966 | Kempton | 102/67 |
| 3,263,612 | 8/1966 | Throner | 102/67 |

FOREIGN PATENTS OR APPLICATIONS

| | | | |
|---|---|---|---|
| 1,092,563 | 11/1954 | France | 102/24 HC |

*Primary Examiner*—David H. Brown

*Attorney, Agent, or Firm*—Toren, McGeady & Stanger

[57] ABSTRACT

A splinter warhead for guiding flying bodies for combating aerial targets by detonation by a proximity fuse upon close approach to the target includes front and rear body portions interconnected by a warhead envelope constructed as a splinter warhead transporting structural member carrying an explosive charge detonatable by the proximity fuse. The explosive charge, which has an essentially circular cross section, has a lining of pre-formed splinters on its peripheral surface, this lining being disposed between the explosive charge and the warhead envelope. The pre-formed splinters have essentially a ball or spherical shape and an individual weight of less than 1 g. The average diameter of the explosive charge is more than 25 times the average diameter of the splinters. The splinters may be arranged in a single layer or in more than one layer, and may be all of the same diameter, or the splinters may be of different diameters and be arranged in groups with each group comprising splinters of the same diameter.

10 Claims, 4 Drawing Figures

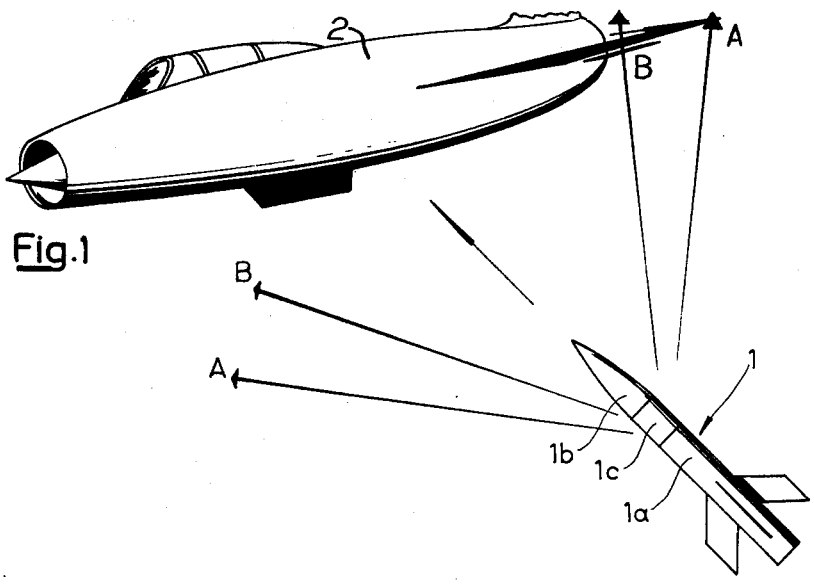
Fig.1
Fig.2
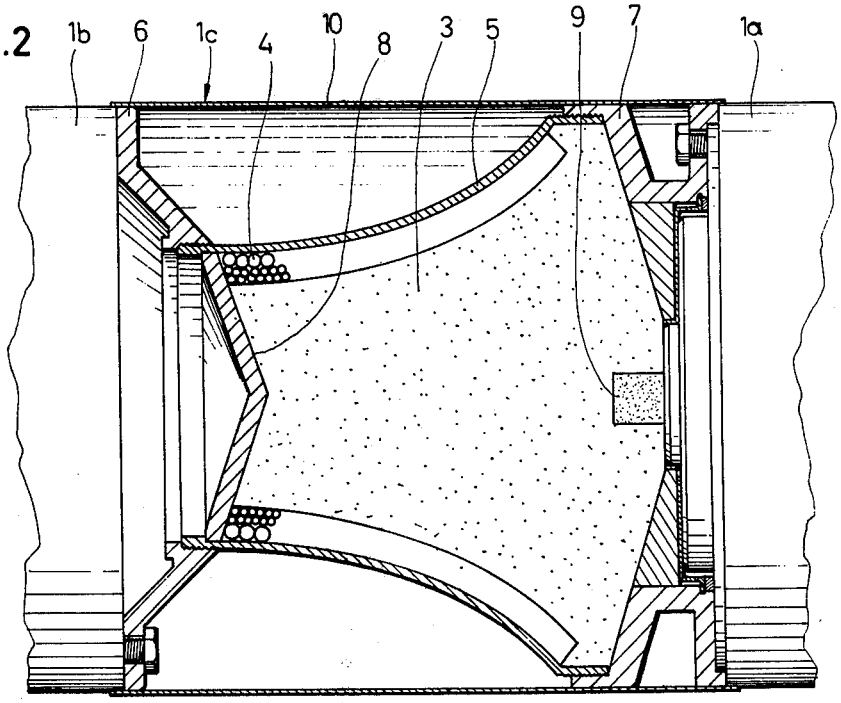
Inventor
FRANZ R. THOMANEK
by McGlew & Toren
Attorneys

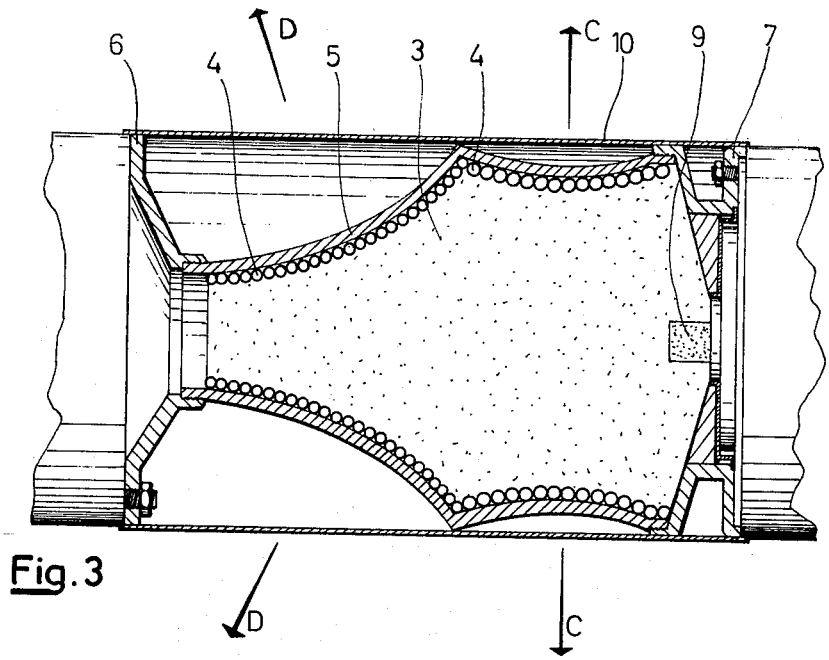
Fig. 3
Fig. 4
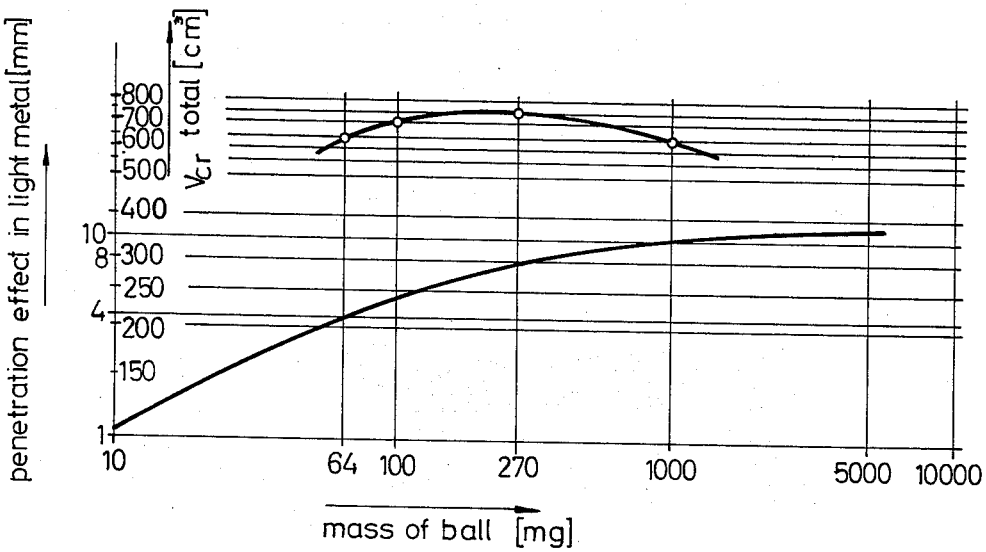
Inventor
FRANZ R. THOMANEK
by McGlew & Toren
ATTORNEYS

SPLINTER WARHEAD FOR GUIDED FLYING BODIES FOR COMBATING AERIAL TARGETS

CROSS REFERENCE TO RELATED APPLICATION

This application is a continuation-in-part of my copending application Ser. No. 670,481, filed June 26, 1967, for "MISSILE FOR USE AGAINST FLYING TARGETS," now abandoned.

BACKGROUND OF THE INVENTION

With respect to flying bodies used for combating high velocity aerial targets, it is hardly possible to construct the explosive charge large enough that the pressure action, upon detonation of the charge, is sufficient by itself to cause destruction of the aerial target. For this reason, such flying bodies include warheads which form splinters or fragments upon detonation of the explosive charge. The energy of the explosive charge, by means of the splinters or particles formed from the envelope of the warhead, can consequently act on the target at a distance in excess of the distance from the warhead to the aerial target upon detonation of the explosive charge. It is thus possible to extend the destructive action to distances of up to 10 to 20 meters.

It has been proposed to construct warheads for flying bodies of the mentioned type, wherein the required condition is met by providing the envelope for the warhead, at its circumference, with a number of hollow charge linings with radially outwardly directed hollow space axes. For example, see Secret French Pat. applications *PV*847 and *PV*999891.

In this prior art construction, the envelope of the warhead is also constructed as a supporting or carrying structural member, and is thus capable of absorbing the forces which occur during transportation, during handling, or during flight of the flying body. The hollow charges generate, upon detonation of the explosive charge, rays or jets which, after a brief period, dissolve into particles and, due to the high velocity and inspite of the small mass of the individual particles, have a good penetrating effect at distances which may amount to several meters. The total number of such particles is dependent primarily on the number of hollow charges provided in the warhead. A single one of the hollow charges forms about 100 particles which are capable of penetrating light metal of 4 mm thickness at a distance of about 5 meters.

Investigations have demonstrated that the destruction probability is substantially dependent on the effectiveness of the individual particles and on the number of these particles. A particle can be considered as being effective if, within distances of several meters, such as are practically feasible, the particle is capable of penetrating a light meter sheet of several mm thickness, preferably 4 to 8 mm.

Explosive charges utilizing pre-formed splinters, or explosive charges which form splinters from the envelope of the charge, have already been proposed as in, for example, German Auslegeschrift 1,164,883, 1,134,003 and 1,187,960, and U.S. Pat. No. 2,762,303. However, such splinter charges have been used for entirely different fields of application, such as, for example, hand grenades, rifle shells, splinter shells and the like. These known arrangements have the disadvantage that their effectiveness by no means approaches the optimum. Thus, in some prior art constructions, the number of splinters is sufficient but the penetration effect is too small. On the other hand, if the mass of the splinters is large, in which event the penetration effect would be correspondingly large, the number of splinters is not sufficient to obtain a sufficient destruction probability. Warheads of the mentioned kind are thus not suitable for combating and destroying modern and high air speed aerial targets.

SUMMARY OF THE INVENTION

The present invention is directed to a warhead for flying bodies, of the type mentioned, constructed in such a manner that, within a limited distance of about 10 to 20 meters, a maximum number of particles are generated and have an optimum effectiveness with respect to their penetration action. For this purpose, the circumferential periphery of the explosive charge is coated with a lining or layer of pre-formed splinters, this lining or layer being disposed between the circumferential periphery of the explosive charge and the warhead envelope. The pre-formed splinters have an essentially spherical or ball form, and have an individual weight of less than 1 g, with the diameter of the explosive charge having an average value of more than 25 times the average diameter of the splinters.

In the development of warheads for guided flying bodies of this type to which the invention is directed, it has quite clearly been overlooked previously that there is a range between the known previous proposals of the prior art and what must be considered as the optimum solution. According to previous experience, it appears that the choice of splinter mass was predetermined by the parameters of splinter number, on the one hand, and penetration effect, on the other hand, and in such a manner that it appeared to be impossible to arrive at a suitable dimensioning of the warhead. This was the basis for the development of the previously mentioned warhead with multiple hollow-shaped charges.

Intensive experiments and investigations of prior art multiple hollow charge constructions, by means of x-rays, flash photography, and penetration measurements, have indicated that the mass of the individual particles surprisingly amounts to only fractions of 1 gram. Based on this determination, extensive experiments with cylindrical explosive charges were conducted, the end surfaces of the cylindrical charges being coated or fitted with steel balls of 170 mg weight and with a ball diameter of 3 mm. In conducting these experiments, charges were concave, plane and convex end surfaces were covered with balls, and saddle surfaces with grooves or channels having the cross section of a circular arc were also examined.

A surprisingly large penetration effect within a distance of 5 meters was found. The direction of the ray or jet of the particles found could be influenced by the form or shape of the particle-coated surface of the explosive charge. Thus, hollow charges having the hollow space lined with balls yielded the smallest diameter rays or jets, concentrated on the axis of the hollow space, with splinter speeds between 2,500 and 1,000 meters per second. Due to the shape of the hollow space, there is formed a ray or jet similar to that formed in known hollow charges, but also having the greatest difference in speed between the leading or front splinters, which move most rapidly, and the trailing or last splinters, which move slowly.

By contrast, using plane or curved end surfaces covered with ball, essentially uniform speeds of about 2,000 meters per second were obtained. Following the conclusion of these experiments, larger explosive charges were built wherein a lining or coating of balls was arranged around the circumferential periphery of the explosive charge. With these charges which, to a large extent, were adapted to the desired form to the warhead, the velocity of the balls was further increased as well as their penetration capabilities. For example, if the penetration effect through 4 mm of light metal sheet is required, it is possible to obtain this penetration with balls of 64 mg having a ball diameter of 2.5 mm, with the number of balls, with an explosive charge of 2.5 kg, increasing to 30,000 with a ball weight of 1.9 kg. The number of balls is thus approximately five times as great as that obtainable with a comparable multi-hollow charge warhead from which particles are formed from the coatings of the hollow charges.

Correspondingly, with the present invention, it is possible to construct the same warhead with a total ball weight of 270 mg and with a ball diameter of 4 mm, so that about 7,000 penetrating particles are formed which are capable of penetrating 8 mm through light metal sheet. In comparison to the multiple-hollow charge warhead, the number of particles is thus only slightly increased but the penetration effect is doubled.

In order to obtain a greater destructive action by providing a larger splinter density, it is possible, in accordance with a further feature of the invention, to arrange the splinters in several layers around the circumferential periphery of the explosive charge. The multi-layer arrangement of the splinters results in a somewhat lower splinter speed, but this disadvantage can be overcome by correspondingly increasing the diameter of the explosive charge.

In the invention warhead, it is of significant importance that the form or shape of the explosive charge is so chosen that the high pressure zone in the charge becomes as large as possible, to wit, the volume between the detonation wave and the dilution wave becomes as large as possible. A particularly effective form of explosive charge is one whose circular periphery is developed by a generatrix comprising two circular arcs. Correspondingly, and considering the propagation direction of the detonation wave in the explosive charge, upon detonation of the charge, there are formed two annular splinter rays or jets with different divergences or spread angles. The splinter coating in a warhead of this type can be provided in such a manner that separate jets comprising splinters of respectively different mass are formed.

This is so, because, in the mathematical analysis of the manner of action of such warheads or explosive charges whose outer form is developed by a generatrix composed of two circular arcs, it has been ascertained that splinters of smaller mass, and thus smaller penetration effect, have to be slanted or inclined more towards the front. Particularly with respect to different aerial targets which are difficult to combat, it may be suitable to divided the generally uniform ray or jet and to use a warhead with an explosive charge such as just mentioned.

According to a further feature of the invention, the splinter rays or jets are directed narrowly on an imaginary circle surrounding or enveloping the warhead. In this manner, an improvement of the effectiveness is obtained by a greater concentration of the ray or jet, to an extent such that the density of the splinters in the jet is sufficient that all of the jets penetrate the target along a relatively narrow zone to actually cut through the target. This cutting action occurs when the pentration holes contact each other so that the effects of the individual splinters or fragments are compounded and are combined whereby the penetration holes not only cause weakening of the areas which have been struck, by forming therethrough, but also a complete destruction of the struck areas is obtained.

Although the invention is particularly directed to the use of the balls as splinter coatings, it will be appreciated that splinters of other shapes, that is, having shapes other than spherical, could also be used. Generally, it is advantageous if the splinter shapes are so chosen that two conditions are met:

1. The pre-shaped splinters should, if possible, be closely adjacent each other without any gaps therebetween;

2. The splinter shape, after detonation of the explosive charge, should deviate as little as possible from a spherical or ball shape and should not have any sharp contours, in order to maintain the air resistance of the splinters as small as possible.

Both of these conditions are fulfilled in accordance with the invention, by balls or spheres which are faceted, for example balls with rectangular or hexagonal cross sections.

As mentioned, the specific weight of the pre-shaped splinters is of essential importance for the penetration effect. If the action distance is to be large, specifically heavier materials than steel will provide more favorable results. However, it has been ascertained, that the pre-shaped splinters, upon detonation of the charge, have a tendency to break easily if the splinter material is too brittle. This means that, for example, steel splinters or balls should be previously annealed into a relatively soft state. Furthermore, the travel time of the impact waves in the splinters should be much shorter than the action time of the pressure of the explosive charge vapors.

Many of the imperfect results obtained with prior art splinter warheads are due to the fact that these conditions were not met, so that the splinters broke into several pieces. These fragments of the splinters, however, do not have sufficient penetration capability.

In accordance with a further embodiment of the invention, not only can massive or solid splinters be used, but also hollow filled splinters. While it is not possible to use lead as a splinter material because lead, upon detonation of the explosive charge, has a tendency to atomize, hollow steel balls filled with lead can be used. Such ball splinters have a particular advantage with respect to very substantial density.

In addition to ball splinters of the type mentioned, it is also possible, in accordance with the invention, to use hollow balls filled with igniting masses such as, for example, thermit, phosphorus, magnesiumtellurium and the like. Splinters of this type have the additional advantage of providing an igniting action with respect to ignitable material of the target.

In accordance with a further feature of the invention, the splinter interspaces are filled with inert material such as, for example, synthetic resins, low melting point metals, or the like. In place of using inert substances for filling the interspaces, the latter may be filled by explosive materials. While the inert substances have essentially a damming effect, the use of explosive materials as fillers for the interspaces increases the pressure action of the charge.

In accordance with a further feature of the invention, the envelope for the warhead comprises a very stable material which has, as compared to the splinter lining on the explosive charge, a much smaller mass per unit area. With this construction of the envelope, it is assured, on the one hand, that the supporting and connecting function of the envelope is completely fulfilled and, on the other hand, the penetration effect of the splinters is not adversely affected. The envelope of the warhead of the invention thus has neither a positive effect nor a negative effect on the effectiveness of the warhead.

To enlarge the destructive action of the warhead of the invention, it is also possible to construct the warhead in such a manner that the explosive charge, in addition to having a splinter lining on its circular periphery, has, at its front end pointing toward the target, a cone-shaped hollow space with a lining. This lining has, on the one hand, the function of damming so that the explosive vapors cannot expand so rapidly from the explosive charge space. On the other hand, this lining forms an axial ray or jet whose particles can penetrate the point or front end of the flying body and any built-in structures therein without difficulty. In the event that the axis of the flying body points toward the target, this thereby results in a considerable additional destructive effect. A warhead construction of this type is particularly advantageous in the event that the proximity fuse of the flying body should prematurely trigger the detonation of the charge, so that the splinters of the explosive charge, which are held away in the form of a conical jacket, would not reach the target.

An object of the present invention is to provide an improved splinter warhead for guided flying bodies for combating aerial targets.

Another object of the invention is to provide such a warhead, including a circular cross section explosive charge having a lining of splinter material on its circular peripheral surface and disposed inwardly of the envelope for the warhead.

A further object of the invention is to provide such a warhead in which the lining of splinter material comprises essentially spherical splinters.

Still another object of the invention is to provide such a warhead in which the splinter lining may be arranged in one layer or in more than one layer.

A further object of the invention is to provide such a warhead in which the periphery of the explosive charge is formed by a generatrix comprising two circular arcs.

Yet another object of the invention is to provide such a warhead including splinter elements which are spherical or ball-shaped and including balls of respective different diameters, arranged in groups each including balls of one respective diameter.

A further object of this invention is to provide such warhead in which the forward end of the explosive charge is formed with a cone-shaped hollow space coaxial with the explosive charge and having a lining or coating.

Another object of the invention is to provide an improved splinter warhead in which the splinters are ball- or spherical shaped particles, with the balls being hollow and filled with either an inert material or an ignitable material.

A further object of this invention is to provide such a warhead in which the inner spaces between the balls are filled either with an inert material or an explosive material.

BRIEF DESCRIPTION OF THE DRAWINGS

For an understanding of the principles of the invention, reference is made to the following description of typical embodiments thereof as illustrated in the accompanying drawings.

In the drawings:

FIG. 1 is a schematic or diagrammatic representation of a flying body, incorporating a warhead in accordance with the invention, approaching a target and shortly before detonation of the explosive charge;

FIG. 2 is a longitudinal or axial sectional view through one form of warhead embodying the invention;

FIG. 3 is a longitudinal or axial section through another form of warhead embodying the invention and which is capable of forming two splinter rays or jets; and FIG. 4 is a graphical illustration of the penetration effect of ball splinters of various mass with a predetermined explosive charge.

DESCRIPTION OF THE PREFERRED EMBODIMENTS

Referring to FIG. 1, a guided flying body 1 is illustrated as approaching an aerial target 2. Flying body 1 comprises a rear portion 1a accommodating the driving means, such as a jet engine, a front portion 1b, with built-in electronic components, and a warhead 1c of the splinter type and which connects the flying body portions 1a and 1b. The construction of the intermediate warhead portion 1c will be described more in detail with respect to the other figures of the drawings.

Upon detonation of the explosive charges in warhead 1c by means of a proximity fuse or igniting means (not shown in detail), there is formed a cone-shaped splinter ray or jet which is directed forwardly of the direction of movement of body 1, the action range of this ray or jet being indicated by the arrows A and B.

FIG. 2 illustrates one embodiment of a splinter warhead in accordance with the invention, and in which a circular cross section explosive charge 3 has an essentially truncated cone-like configuration. At the outer circumferential periphery of charge 3 there are arranged, in several layers, ball or spherical shaped splinters 4. As will be clear from FIG. 2, splinters 4 have different sizes, the smaller splinters being arranged directly adjacent the periphery of the explosive charge 3 while the large splinters are arranged as the radially outer layer. However, the invention is not limited to this arrangement of the splinter balls, as the arrangement may be reversed so that the larger splinters are in direct contact with the periphery of charge 3 and the smaller splinters are radially outermost. Also, splinters of the same size, of the same mass, or of the same size and mass could be used.

Explosive charge 3 and splinter coating 4 are surrounded by a very stable envelope 5, for example of steel sheet, which also forms a supporting connection between flying body portions 1*a* and 1*b*. This connection is effected by virtue of flange 6 at the rear end of front flying body portion 1*b* and flange 7 at the forward end of rear flying body portion 1*a*. For example, envelope 5 may be threaded into the flanges 6 and 7, as shown in FIG. 2. It thereby forms a positive force transmitting connection of the parts of the flying body. The warhead furthermore includes a covering or lining 10.

In addition to being embraced by the splinter coating 4, explosive charge 3 has, at its front end which is directed toward the target, a cone-shaped hollow space with a coating or lining 8 which may comprise, for example, aluminum. Upon detonation of charge 3 by detonator 9, lining or coating 8 forms a hollow charge ray, jet, or thorn.

In the embodiment of the invention shown in FIG. 3, envelope 5 of explosive charge 3 is defined by a generatrix comprising two circular arcs. Consequently, and considering the propagation direction of the detonation wave in the explosive charge, there are formed two annular splinter rays or jets of which one is directed essentially in a lateral direction, as indicated by arrows C, and the other, which is is indicated by arrows D, is directed in a direction similar to the ray or jet of the embodiment shown in FIG. 1. That is, it is slanted or inclined forwardly.

As distinguished from the embodiment of FIG. 2, in the embodiment of FIG. 3 there is only a single layer of splinters, although the splinters are arranged in two groups, with the forward group comprising smaller diameter splinters and the rear group comprising larger diameter splinters. In the embodiment of FIG. 3, the interspaces between the splinters 4 are filled by an explosive material.

FIG. 4 illustrates two curves, the lower curve illustrating the penetration effects for balls or different sizes for a predetermined explosive charge or for the impulse defined by the explosive charge. Surprisingly, the penetration effects do not increase proportionally to the mass of the splinters, but they tend to approach a maximum value. If it is considered that the total mass of the balls in a warhead has a fixed value, for example 2 kg, then the number of balls for each size of balls can be calculated, as the larger the size of the balls, the smaller the number of balls required.

For a predetermined ball size, there is formed, from the ball cross section and the penetration effect, a crater volume which, multiplied with the number of balls, indicates the total volume of the crater $\Sigma V_{Kr}$. As indicated by the upper curve in FIG. 4, this value has a maximum, in the illustrated example, with a ball of 3.6 mm diameter or a mass of 200 mg. Based on this, and by correspondingly choosing the size of ball which, as mentioned, is determined in dependence on the respective charge, a maximum of the energy can be cncentrated toward the aerial target since, as is known, the crater volume is a measure of the energy.

While specific embodiments of the invention have been shown and described in detail to illustrate the application of the principles of the invention, it will be understood that the invention may be embodied otherwise without departing from such principles.

What is claimed is:

1. In a guided flying body for combating aerial targets, and of the type including front and rear body portions interconnected by a warhead envelope constructed as a splinter warhead transporting structural member carrying an explosive charge detonatable by a proximity fuse upon approach of the flying body to a target: the improvement in which said warhead comprises, in combination, a circular cross section explosive charge; a warhead envelope surrounding said charge; and a lining of pre-formed splinters on the circumferential periphery of said explosive charge and within said warhead envelope; said splinters having essentially a ball shape and an individual weight of less than 1 g; the average value of the diameter of said explosive charge being in excess of 25 times the average value of the diameter of said splinters; the circumferential peripheral surface of said explosive charge being outwardly concave and defined by an arcuate generatrix; the rear portion of said outward concave surface being a substnatial distance radially outwardly of the front portion of said outwardly concave surface, whereby, upon detonation of said explosive charge, a cone-shaped splinter ray is directed forwardly of the direction of movement of said body.

2. A splinter warhead, as claimed in claim 1, in which said splinters are arranged in plural radially adjacent layers.

3. A splinter warhead, as claimed in claim 1, in which the splinter rays, upon detonation of said charge, are directed in a narrow and imaginary circle surrounding said warhead.

4. A splinter warhead, as claimed in claim 1, in which said splinters have facets.

5. A splinter warhead, as claimed in claim 1, in which said splinters are hollow and are filled with active substances.

6. A splinter warhead, as claimed in claim 1, including inert material filling the splinter interspaces.

7. A splinter warhead, as claimed in claim 1, including explosive material filling the splinter interspaces.

8. A splinter warhead, as claimed in claim 1, in which said warhead envelope comprises a very stable material having, as compared to said splinters, a smaller mass per unit area.

9. A splinter warhead, as claimed in claim 1, in which said explosive charge has its forward end, which is pointed toward the target, formed with an outwardly facing conical hollow space coaxial with said explosive charge, said hollow space having a metal lining.

10. A splinter warhead, as claimed in claim 1, in which the circumferential peripheral surface of said explosive charge is defined by an arcuate generatrix comprising two intersecting circular arcs whose respective centers are spaced substantially from each other.

* * * * *